US012698546B2

(12) United States Patent
Qiao et al.

(10) Patent No.: US 12,698,546 B2
(45) Date of Patent: Aug. 4, 2026

(54) METHOD FOR RECOVERING LITHIUM FROM WASTE LITHIUM IRON PHOSPHATE (LFP) MATERIAL

(71) Applicants: GUANGDONG BRUNP RECYCLING TECHNOLOGY CO., LTD., Foshan (CN); HUNAN BRUNP RECYCLING TECHNOLOGY CO., LTD., Changsha (CN); HUNAN BRUNP EV RECYCLING CO., LTD., Changsha (CN)

(72) Inventors: Yanchao Qiao, Foshan (CN); Ruokui Chen, Foshan (CN); Dingshan Ruan, Foshan (CN); Feng Tan, Foshan (CN); Xie Sun, Foshan (CN); Xianliang Zheng, Foshan (CN); Changdong Li, Foshan (CN)

(73) Assignees: GUANGDONG BRUNP RECYCLING TECHNOLOGY CO., LTD., Foshan (CN); HUNAN BRUNP RECYCLING TECHNOLOGY CO., LTD., Changhsha (CN); HUNAN BRUNP EV RECYCLING CO., LTD., Changsha (CN)

( * ) Notice: Subject to any disclaimer, the term of this patent is extended or adjusted under 35 U.S.C. 154(b) by 513 days.

(21) Appl. No.: 18/212,713

(22) Filed: Jun. 21, 2023

(65) Prior Publication Data

US 2023/0332273 A1 Oct. 19, 2023

Related U.S. Application Data

(63) Continuation of application No. PCT/CN2022/095684, filed on May 27, 2022.

(30) Foreign Application Priority Data

Aug. 3, 2021 (CN) ..... 202110885754.X

(51) Int. Cl.
*C22B 26/12* (2006.01)
*C22B 7/00* (2006.01)

(52) U.S. Cl.
CPC ..... *C22B 26/12* (2013.01); *C22B 7/007* (2013.01)

(58) Field of Classification Search
None
See application file for complete search history.

(56) References Cited

FOREIGN PATENT DOCUMENTS

| | | | |
|---|---|---|---|
| CN | 103035977 B | * | 12/2015 |
| CN | 109554545 A | | 4/2019 |
| CN | 110331288 A | | 10/2019 |
| CN | 109554545 B | * | 12/2020 |
| CN | 112441572 A | | 3/2021 |
| CN | 112811404 A | | 5/2021 |

OTHER PUBLICATIONS

CN 109554545 B, Machine-generated English translation (Year: 2020).*
CN 103035977 B, Machine-generated English translation (Year: 2015).*
International Search Report of PCT Patent Application No. PCT/CN2022/095684 issued on Aug. 24, 2022.

* cited by examiner

*Primary Examiner* — Yun Qian
(74) *Attorney, Agent, or Firm* — Westbridge IP LLC

(57) ABSTRACT

This disclosure discloses a method for recovering lithium from a waste LFP material, including: S1. adding water to the waste LFP material, controlling a pH thereof at 0.5 to 2.0 and an ORP of the slurry at 0.05 V to 1.2 V, and filtering to obtain a material A; S2. adding sulfuric acid and heating a resulting mixture at 100° C. to 400° C. in the air or an oxygen atmosphere to obtain a material B; S3. adding water to the material B, and stirring and filtering to obtain a material C; S4. controlling a pH of the material C at 9 to 11, and filtering a resulting mixture to obtain a material D; S5. passing the material D through an ion-exchange resin to obtain a material E; and S6. adding the material E to a sodium carbonate solution to react; and collecting a resulting solid to obtain lithium carbonate.

5 Claims, No Drawings

METHOD FOR RECOVERING LITHIUM FROM WASTE LITHIUM IRON PHOSPHATE (LFP) MATERIAL

CROSS-REFERENCE TO RELATED APPLICATIONS

The present application is a continuation application of PCT application No. PCT/CN2022/095684 filed on May 27, 2022, which claims the benefit of Chinese Patent Application No. 202110885754.X filed on Aug. 3, 2021. The contents of all of the aforementioned applications are incorporated by reference herein in their entirety.

TECHNICAL FIELD

The present disclosure relates to the recycling of lithium battery materials, and in particular to a method for recovering lithium from a waste lithium iron phosphate (LFP) material.

BACKGROUND

With the increasing demand for lithium, the recovery of lithium from waste lithium battery materials has become an important research topic. LFP is currently the most widely used lithium-ion battery (LIB) material. After thousands of cycles, an LFP battery shows a declining battery capacity and is finally scrapped, resulting in a waste LFP battery material. Waste LFP battery materials, if not effectively recycled, will accumulate in large quantities, pollute the environment, and result in waste of precious lithium resources. Therefore, the recovery of metal elements in waste LFP batteries, especially the recovery of lithium, has some environmental significance and high economic value.

SUMMARY

The present disclosure is intended to overcome the shortcomings in the prior art and provide a method for recovering lithium from a waste LFP material.

To achieve the above objective, the present disclosure adopts the following technical solution: A method for recovering lithium from a waste LFP material is provided, including the following steps:

S1. adding water to the waste LFP material to prepare a slurry, controlling a pH of the slurry at 0.5 to 2.0 and an oxidation-reduction potential (ORP) of the slurry at 0.05 V to 1.2 V, and filtering the slurry to obtain a filter residue, which is a material A;

S2. adding sulfuric acid to the material A, and heating a resulting mixture at 100° C. to 400° C. in the air or an oxygen atmosphere to obtain a material B;

S3. adding water to the material B, and stirring and filtering to obtain a filtrate, which is a material C;

S4. controlling a pH of the material C at 9 to 11, and filtering a resulting mixture to obtain a filtrate, which is a material D;

S5. passing the material D to pass through an ion-exchange resin to obtain a material E; and S6. adding the material E to a sodium carbonate solution to react; and collecting a resulting solid to obtain lithium carbonate.

In step S1, water is added to the waste LFP material to prepare a slurry, and a pH of the slurry is controlled at 0.5 to 2.0 and an ORP of the slurry is controlled at 0.05 V to 1.2 V to obtain an aluminum-containing solution and an aluminum-free LFP powder (material A). In step S2, sulfuric acid is added to the LFP powder (material A) and a resulting mixture is heated at 100° C. to 400° C. in the air or an oxygen atmosphere to obtain a mixture of iron phosphate and lithium sulfate (material B). In step S3, water is added to the mixture of iron phosphate and lithium sulfate (material B), and a resulting mixture is filtered to obtain a lithium sulfate solution (material C) (mechanism: lithium sulfate is soluble in water, but iron phosphate is insoluble). In step S4, pH of the lithium sulfate solution (material C) is controlled at 9 to 11 to further remove the impurity of iron phosphate, such that a purified lithium sulfate solution (material D) is obtained. In step S5, the purified lithium sulfate solution (material D) is passed through an ion-exchange resin such that calcium impurities can be thoroughly removed to obtain a further-purified lithium sulfate solution (material E). In step S6, the further-purified lithium sulfate solution (material E) is added to a sodium carbonate solution to react, and a lithium carbonate insoluble substance is obtained. The method of the present disclosure has the advantages of easy industrialization, simple operation, and low cost. The method of the present disclosure can achieve a lithium recovery rate of more than 99%, has high recovery efficiency, and can lead to battery-grade lithium carbonate.

As a preferred implementation of the method of the present disclosure, in S1, the ORP may be 0.2 V to 0.5 V. This potential allows excellent aluminum removal effect.

As a preferred implementation of the method of the present disclosure, in S1, the ORP may be controlled by adding sodium chlorate and/or hydrogen peroxide. The sodium chlorate and/or hydrogen peroxide can be added in a manner of continuous feeding.

As a preferred implementation of the method of the present disclosure, in S1, the pH may be controlled by adding a sulfuric acid solution and/or a hydrochloric acid solution. The sulfuric acid solution and/or hydrochloric acid solution can be added in a manner of continuous feeding.

As a preferred implementation of the method of the present disclosure, in S2, the sulfuric acid may have a mass concentration of 10% to 98%. More preferably, in S2, the sulfuric acid may have a mass concentration of 50% to 98%. This sulfuric acid concentration allows high reaction rate and energy conservation.

As a preferred implementation of the method of the present disclosure, in S2, the sulfuric acid may be added at an amount such that a molar ratio of hydrogen ion to lithium in the resulting mixture is 1.0 to 1.5.

As a preferred implementation of the method of the present disclosure, in S2, the heating may be conducted for 1 h to 5 h.

As a preferred implementation of the method of the present disclosure, in S2, the heating may be conducted at 150° C. to 250° C. Reaction at this temperature can achieve both prominent reaction efficiency and large energy conservation.

As a preferred implementation of the method of the present disclosure, in S4, the pH may be adjusted by adding lithium carbonate and/or sodium carbonate.

Beneficial effects of the present disclosure: The method of the present disclosure has the advantages of easy industrialization, simple operation, and low cost. The method of the present disclosure can achieve a high lithium recovery rate of more than 99%, and can lead to battery-grade lithium carbonate.

DETAILED DESCRIPTION

Unless otherwise specified, the materials and reagents used in the examples all are purchased from the market. In order to well illustrate the objectives, technical solutions, and advantages of the present disclosure, the present disclosure will be further described below in conjunction with specific examples.

Example 1

An implementation of the method for recovering lithium from a waste LFP material according to the present disclosure was provided in this example, and the method included the following steps:

S1. water was added to the waste LFP material to prepare a slurry, sulfuric acid was added to control a pH of the slurry at 1 and hydrogen peroxide was added to control an ORP of the slurry at 0.2 V, and the slurry was filtered to obtain a filter residue, which was a material A;

S2. sulfuric acid with a mass concentration of 50% was added to the material A at an amount such that a molar ratio of hydrogen ion to lithium in the resulting mixture was 1.3, and a resulting mixture was heated at 250° C. for 2 h in the air atmosphere to obtain a material B;

S3. water was added to the material B, and a resulting mixture was stirred and filtered to obtain a filtrate, which was a material C;

S4. lithium carbonate was added to control a pH of the material C at 10, and a resulting mixture was filtered to obtain a filtrate, which was a material D;

S5. the material D was passed through an ion-exchange resin to obtain a material E; and S6. the material E was added to a sodium carbonate solution to react, and a resulting solid was collected and dried to obtain lithium carbonate.

As calculated, the method in this example can lead to a lithium yield of 99.9%, and a calculation formula of lithium yield is as follows: amount of lithium in material C/amount of lithium in waste LFP material×100%.

Example 2

An implementation of the method for recovering lithium from a waste LFP material according to the present disclosure was provided in this example, and the method included the following steps:

S1. water was added to the waste LFP material to prepare a slurry, sulfuric acid was added to control a pH of the slurry at 0.5 and hydrogen peroxide was added to control an ORP of the slurry at 0.05 V, and the slurry was filtered to obtain a filter residue, which was a material A;

S2. sulfuric acid with a mass concentration of 10% was added to the material A at an amount such that a molar ratio of hydrogen ion to lithium in the resulting mixture was 1.0, and a resulting mixture was heated at 100° C. for 5 h in the air atmosphere to obtain a material B;

S3. water was added to the material B, and a resulting mixture was stirred and filtered to obtain a filtrate, which was a material C;

S4. sodium carbonate was added to control a pH of the material C at 11, and a resulting mixture was filtered to obtain a filtrate, which was a material D;

S5. the material D was passed through an ion-exchange resin to obtain a material E; and S6. the material E was added to a sodium carbonate solution to react, and a resulting solid was collected to obtain lithium carbonate.

As calculated, the method in this example can lead to a lithium yield of 99.0%, and a calculation formula of lithium yield is as follows: amount of lithium in material C/amount of lithium in waste LFP material×100%.

Example 3

An implementation of the method for recovering lithium from a waste LFP material according to the present disclosure was provided in this example, and the method included the following steps:

S1. water was added to the waste LFP material to prepare a slurry, sulfuric acid was added to control a pH of the slurry at 2.0 and hydrogen peroxide was added to control an ORP of the slurry at 1.2 V, and the slurry was filtered to obtain a filter residue, which was a material A;

S2. sulfuric acid with a mass concentration of 10% was added to the material A at an amount such that a molar ratio of hydrogen ion to lithium in the resulting mixture was 1.5, and a resulting mixture was heated at 400° C. for 3 h in the air atmosphere to obtain a material B;

S3. water was added to the material B, and a resulting mixture was stirred and filtered to obtain a filtrate, which was a material C;

S4. lithium carbonate was added to control a pH of the material C at 9, and a resulting mixture was filtered to obtain a filtrate, which was a material D;

S5. the material D was passed through an ion-exchange resin to obtain a material E; and S6. the material E was added to a sodium carbonate solution to react, and a resulting solid was collected to obtain lithium carbonate.

As calculated, the method in this example can lead to a lithium yield of 99.3%, and a calculation formula of lithium yield is as follows: amount of lithium in material C/amount of lithium in waste LFP material×100%.

Example 4

An implementation of the method for recovering lithium from a waste LFP material according to the present disclosure was provided in this example, and the method included the following steps:

S1. water was added to the waste LFP material to prepare a slurry, sulfuric acid was added to control a pH of the slurry at 1.0 and hydrogen peroxide was added to control an ORP of the slurry at 0.5 V, and the slurry was filtered to obtain a filter residue, which was a material A;

S2. sulfuric acid with a mass concentration of 50% was added to the material A at an amount such that a molar ratio of hydrogen ion to lithium in the resulting mixture was 1.5, and a resulting mixture was heated at 150° C. for 1 h in the air atmosphere to obtain a material B;

S3. water was added to the material B, and a resulting mixture was stirred and filtered to obtain a filtrate, which was a material C;

S4. lithium carbonate and sodium carbonate were added to control a pH of the material C at 10, and a resulting mixture was filtered to obtain a filtrate, which was a material D;

S5. the material D was passed through an ion-exchange resin to obtain a material E; and S6. the material E was added to a sodium carbonate solution to react, and a resulting solid was collected to obtain lithium carbonate.

As calculated, the method in this example can lead to a lithium yield of 99.8%, and a calculation formula of lithium yield is as follows: amount of lithium in material C/amount of lithium in waste LFP material×100%.

Finally, it should be noted that the above examples are provided only to illustrate the technical solutions of the present disclosure, rather than to limit the protection scope of the present disclosure. Although the present disclosure is described in detail with reference to preferred examples, a person of ordinary skill in the art should understand that modifications or equivalent replacements may be made to the technical solutions of the present disclosure without departing from the spirit and scope of the technical solutions of the present disclosure.

The invention claimed is:

1. A method for recovering lithium from a waste lithium iron phosphate (LFP) material, comprising the following steps:

S1. adding water to the waste LFP material to prepare a slurry, controlling a pH of the slurry at 0.5 to 2.0 and an oxidation-reduction potential (ORP) of the slurry at 0.2V to 0.5V, and filtering the slurry to obtain a filter residue, which is an aluminum-free LFP power;

S2. adding sulfuric acid to the aluminum-free LFP power, and heating a resulting mixture at 100° C. to 400° C. in the air or an oxygen atmosphere to obtain a mixture of iron phosphate and lithium sulfate;

S3. adding water to the mixture of iron phosphate and lithium sulfate, and stirring and filtering to obtain a filtrate, which is a lithium sulfate solution;

S4. controlling a pH of the lithium sulfate solution at 9 to 11, and filtering to obtain a filtrate, which is a purified lithium sulfate solution;

S5. passing the purified lithium sulfate solution through an ion-exchange resin to obtain a further-purified lithium sulfate solution; and S6. adding the further-purified lithium sulfate solution to a sodium carbonate solution to react; and collecting a resulting solid to obtain lithium carbonate;

wherein in S2, the sulfuric acid has a mass concentration of 50% to 98%;

in S1, the ORP is controlled by adding sodium chlorate and/or hydrogen peroxide and the pH is controlled by adding a sulfuric acid solution or a hydrochloric acid solution.

2. The method according to claim 1, wherein in S2, the sulfuric acid is added at an amount such that a molar ratio of hydrogen ion to lithium in the resulting mixture is 1.0 to 1.5.

3. The method according to claim 1, wherein in S2, the heating is conducted for 1 h to 5 h.

4. The method according to claim 1, wherein in S2, the heating is conducted at 150° C. to 250° C.

5. The method according to claim 1, wherein in S4, the pH is adjusted by adding lithium carbonate and/or sodium carbonate.

* * * * *